US005327676A

United States Patent [19]

Kosky

[11] Patent Number: 5,327,676

[45] Date of Patent: Jul. 12, 1994

[54] CORNER POT HOLDER APPARATUS

[76] Inventor: Paul G. Kosky, 18 Jade Hill Rd., Auburn, Mass. 01501

[21] Appl. No.: 976,252

[22] Filed: Nov. 13, 1992

[51] Int. Cl.[5] ..... A47G 7/00

[52] U.S. Cl. ..... 47/39; 248/312.1

[58] Field of Search ..... 47/39; 248/312.1

[56] References Cited

U.S. PATENT DOCUMENTS

| | | | |
|---|---|---|---|
| 986,395 | 3/1911 | King . | |
| 1,084,414 | 1/1914 | Eger . | |
| 2,316,384 | 4/1943 | Abramson . | |
| 3,099,355 | 7/1963 | Kane | 47/39 |
| 3,542,210 | 11/1970 | Sorensen | 47/39 |
| 3,760,534 | 9/1973 | Choux et al. | 47/39 |
| 4,120,119 | 10/1978 | Engel . | |
| 4,213,271 | 7/1980 | Petruzzi et al. | 47/39 |
| 4,912,876 | 4/1990 | Ginsberg . | |
| 5,118,059 | 6/1992 | Mainer | 248/312.1 |
| 5,127,184 | 7/1992 | Cosentino . | |

FOREIGN PATENT DOCUMENTS

| | | | |
|---|---|---|---|
| 0074638 | 3/1983 | European Pat. Off. | 47/39 |
| 2580458 | 10/1986 | France | 47/39 |
| 614016 | 12/1960 | Italy | 47/39 |

*Primary Examiner*—Ramon S. Britts
*Assistant Examiner*—Joanne C. Downs
*Attorney, Agent, or Firm*—Thomas A. Kahrl

[57] ABSTRACT

A combined corner pot holder and railing apparatus for flush-mounting on the inside corner of a deck/porch railing having a substantial depth to conceal the pots from view a triangular box with horizontally extending flanges for resting on the top of the railing, the flower planter having a flower pot container section defined by three walls connected by a triangular base, the container having a pair of side walls including a first side wall and a second sidewall joined in angular relation, and a back wall. The sidewalls adapted to a butt side portions of the railing and with each sidewall having a horizontally extending support flange configured to extend to fit on the top horizontal surface of the railing keeping the container positioned in the corner of the railing. The two laterally extending support flanges are in orthogonical relationship one to another and each are in orthogonical relationship to the associated sidewall to provide a mating fit to the inside corner of the railing in a manner that requires no attachment fixtures to be pierced into the railing structure for holding the flower pot container in place.

7 Claims, 1 Drawing Sheet

CORNER POT HOLDER APPARATUS

BACKGROUND OF THE INVENTION

The present invention relates generally to planters for containing potted flowers, and more particularly to a flush-mounted pot holder configured to fit at the corner of a porch/deck railing for displaying flowers. Traditionally, planters for containing plants, particularly flowers grown from seedlings in soil, are of elongated box construction commonly attached to a dwelling frame structure, such as a window ledge, by fastening devices to provide a conventional "window box". Alternatively, planters are attached to porch/deck structures, such as railings, configured as elongated rectangular boxes adapted for growing plants in soil contained in said boxes. When filled with soil, these planters are heavy and require structurally strong brackets fastened by screw fasteners into the frame, are accordingly difficult to install, and will disfigure the frame with perforations associated with fastening the brackets. Such planters are installed in plain view and detract from the aesthetic appearance of the dwelling, particularly when the within contained plants are not in bloom.

It is also popular to place planters in interior spaces at home and in offices installed on partial-height walls. Typically, such boxes are placed on top of the partial wall and are held in place by brackets with the planter in plain view. One such device is covered by U.S. Pat. No. 4,912,876, to Grisberg, which is directed to a partition wall planter for mounting on the top of a partial height wall by bottom-mounted support brackets. This planter is positioned on top of the wall which is provided with decorative side panels. The support brackets are secured between the decorative panels and the partition wall frame to hold the planter in place on top of the wall, the walls of the planter being in plain view.

Applicant is also aware of related art in the field of the invention including U.S. Pat. No. 4,129,119 to Engel issued Oct. 17, 1978, and U.S. Pat. No. 1,084,414 to Eger issued Jan. 13, 1944, U.S. Pat. No. 986,395 to King issued Mar. 7, 1911, and to U.S. Pat. No. 2,316,384 to Abramson issued Apr. 13, 1943.

Ginsberg essentially is a triangular planter that may be attached to the corner on top of a partial wall, however, the Ginsberg planter does not have outwardly extending flanges for flush mounting the planter on the side of a partial wall or deck railing. The planter as disclosed by Eger, includes an outwardly extending flange for supporting a flower box on a deck railing being attached by brackets clamped to the railing, however, the planter is mounted on the outside of the railing in plain view, is not adapted for hanging on the inside corner of a railing, the flower box is intended to be conspicuously visible, and is of elongated, gutter type construction. King and Abramson both show containers which have vertical side panels configures to form substantially triangular receptacles, however they are not adapted for use in the corner of a porch railing. Engel discloses an elbow planter box including two trough-like receptacles for forming a continuous planter or a flower box of generally rectangular configuration. The provision for extending the length of a section of the planter by a splicer, and includes an elbow section, however, the Engel planter is adapted for containing plants planted in soil, and is not particularly adapted for containing pots, and includes two box like receptacles and has no integral means of fastening the planter to a structure.

While the above noted patents disclose devices for securing planters to half-walls, and railing and to provide a elbow feature for corner applications in a heretofore acceptable manner, the prior art devices lacked the desirable feature of concealment of the container and pots, and limiting the display to the blooms of plants arranged in the planters.

It is thus apparent that prior art lacks corner plant or devices for flower pots of triangular construction configured to be easily attached to in a flush-mounted manner to the inside portion of a porch railing corner segment, wherein the planter and the within-contained flower pots are obscured from view.

SUMMARY OF THE INVENTION

The present invention relates to a triangular planter for displaying flowers and plants contained in pots in combination with a railing such that the pots are concealed from view, said planter being mounted at the corner of the railing.

In particular, the invention is directed to a flush-mounted, easy to install, triangular container having a pair of top-mounted flanges, orthogonically arranged for positioning up to three flower pots hung at the side of a deck rail on the inside of the rail corner, such that the container is concealed form view from the exterior side of the railing. In the preferred embodiment, the triangular planter includes a container adapted to contain a plurality of flower pots, typically six inch flower pots of conventional design, having a depth of 5" to 5 and ½" which equals the height of the pots, such that the pots are concealed from view by the sidewalls of the container and that only flowers are visible to present an aesthetically pleasing appearance. In practice, it is intended the flower pots be periodically replaced with fresh blooming potted plants to provide a continual display of blooms at the selected corner railing location.

The container, preferably of injection molded construction includes a flat, triangular base, a pair of side walls, and a pair of associated top-mounted flanges, and a back wall. The pair of side walls are constructed to extend vertically at right angles to the base. In the preferred embodiment, the container being configured with a right angle to fit in the interior angled corner of a porch or deck's railing, has two orthogonically positioned side walls extending vertically with the base arranged in perpendicular relation thereto. The height of the side walls is equal to the height of the size of the pot desired to be used with the container, which in the preferred embodiment is a six inch pot having a so called diameter of 6" and a height of 5 to 5 and ½" and extends laterally outwards in the same horizontal plane.

The container may be constructed of sheet metal, preferably 20" gauge material, having a thickness of 0.080"–0.090", however in the preferred embodiment, the container is constructed of plastic material formed by injection molding. The bottom optionally may be provided a plurality of punch-out drain holes, to be punched out for exterior use on a porch; however, when used in indoor applications such as a partial wall in an office or home setting, the drain holes would remain sealed. The base of the container may be filled with peat moss to surround the flower pots to hold moisture for an extended period of time to keep the flowers fresh.

The back wall extends upward in a vertical plane perpendicular to the hypotenuse of the right triangle formed configuration of the base, being joined at opposite ends along the vertical edges of the outer ends of the side walls. Along the top edge of the back wall is a reinforced lip providing for structural rigidity, the top of the lip and the top surface of the flanges being in coplanar relationship.

The pair of top mounted flanges is provided in the preferred embodiment adapted to flush-mount the container below the top surface of the railing. Positioned on the inside of the railing apparatus at a corner, the pair of flanges are formed integrally with the side wall and extend laterally outwards in the same horizontal plane. The flanges are positioned in coplanar angled relationship extending outwardly from the top of the side walls in perpendicular relationship therewith. A truncated cutout is provided at the apex of the angle between the side walls to permit use in a corner of the railing which includes a post.

As provided in the preferred embodiment, the rail apparatus is positioned in spaced relationship with the floor of the deck, extending in a horizontal plane and includes a first railing and a second railing joined at an angle at the corner of the deck. In the preferred embodiment, the angle is 90 degrees, the customary angle of a rectangular shaped deck corner. The railings are positioned on a plurality of posts extending perpendicularly from the floor of the porch, each of the post having a top portion adjacent the railing.

The invention will be described for the purposes of illustration only in connection with certain embodiments; however, it is recognized that those persons skilled in the art may make various changes, modifications, improvements and additions on the illustrated embodiments all without departing from the spirit and scope of the invention.

BRIEF DESCRIPTION OF THE DRAWINGS

Reference is made to the accompanying drawings for a more complete understanding of the subject invention in which.

DETAILED DESCRIPTION OF THE PREFERRED EMBODIMENT

Figure 1:
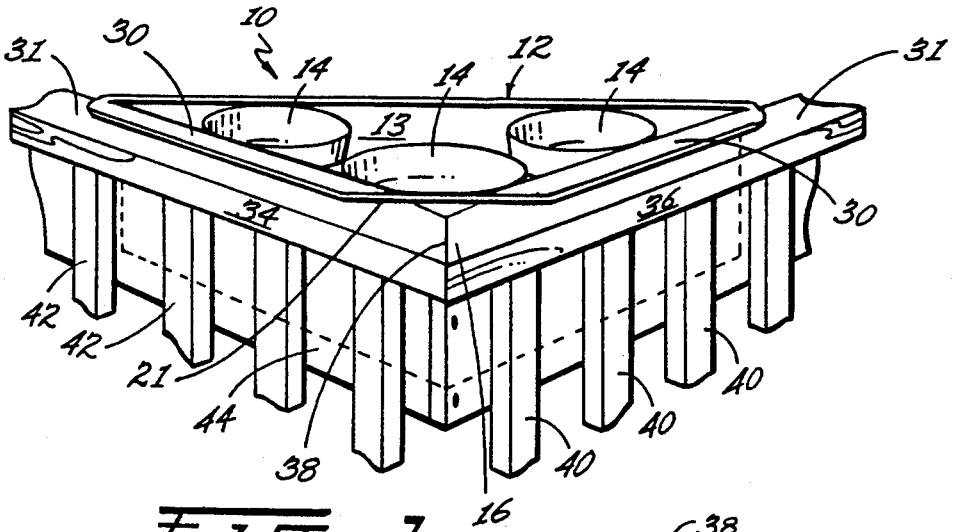
FIG. 1 is a perspective view of the corner pot holder of the present invention illustrative of the same when installed in the corner of a deck/porch railing, containing flower pots.
Figure 2:
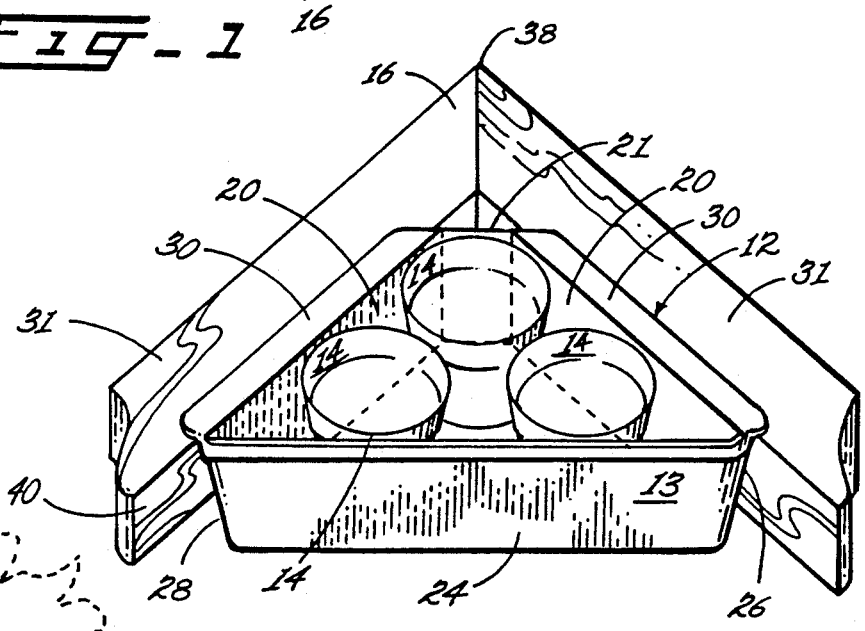
FIG. 2 is a perspective view of the preferred embodiment of the corner pot holder of the present invention with corner cut-out illustrative of the same when installed in the corner of a deck porch railing having a corner post, containing flower pots.
Figure 3:
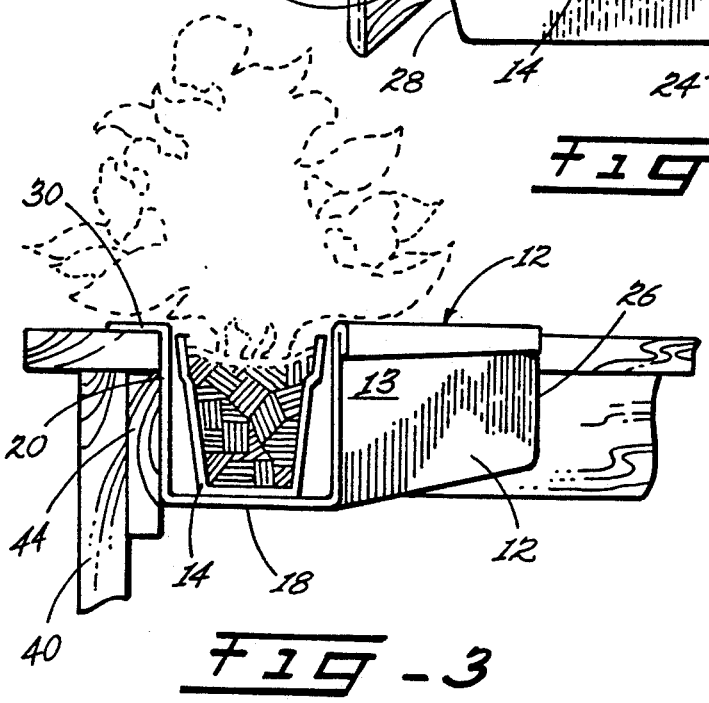
FIG. 3 is a side elevation of a view taken along lines 3—3 of FIG. 2 with plants in use shown in dotted lines.

Referring to the drawings, FIG. 1-3 illustrate the preferred embodiment of the corner pot holder and rail apparatus 10 of the invention showing a triangular container 12 including a plurality of pots 14 positioned in the corner portion of a railing 16.

Said container 12 is of substantial depth and includes a triangular box 13 with a flat base 18, shown in FIG. 3, a pair of sidewalls 20, extending vertically in orthogonical relation to said base and joined along a common vertical truncated panel 21 having a vertical height substantially equal to the height of said pots. The container 12 also includes a back wall 24 extending vertically in orthogonical relation to said base, joined along vertical edges 26 & 28 to the outer edges of said pair of side walls.

The apparatus 10 also includes a pair of flanges 30 positioned on the top surface 31 of the railing 16 for flush-mounting said container means below said top surface of with said flanges being positioned in angled and co-planar relationship extending laterally from the top of the associated side wall 20 in orthogonal relationship therewith.

The railing 16 is supported in spaced relation above a generally horizontal floor, not shown, including a first railing 34 and a coplanar second railing 36 joined at an angle to form a corner 38, by a plurality of posts 40, said posts extending vertically from the floor for supporting said railing in spaced, coplanar relation with the floor, each of said posts having a top portion 42 adjacent the railing 16. The railing in the preferred embodiment includes a first and second transverse beam 44 mounted on the top portion 42 of the post, extending laterally to support the railing 16 and having a vertical height greater than 5" to fully support the pair of sidewalls 20 as shown in FIG. 3.

What is claimed is:

1. A corner pot holder in combination with potted plants and corner railing means comprising:

a) said potted plants being contained in a plurality of plant pots;

b) said corner railing means supporting the corner pot holder in spaced relation above a generally horizontal floor comprising a first railing of generally rectangular configuration and a second railing of generally rectangular configuration joined at a right angle to form said railing corner means;

c) a triangular container body configured as a right triangle including a truncated apex and having an area and depth related to the size of the plant pots comprising:

i) a horizontal base defining a triangular surface supporting said plant pots;

ii) peripheral sidewalls in combination with a horizontal base providing a flower pot planter comprising a first vertical sidewall and a second vertical sidewall joined at a truncation panel adjacent to the truncated apex and a vertical back wall, wherein said vertical sidewalls are positioned in orthogonical relation to the base securely holding a plurality of at least three plant pots with potted plants in a vertical position such that the pots are concealed from view by the container body, the potted plants being plainly visible above the container body and;

iii) support means orienting and supporting the said corner pot holder at the railing corner at the side of the first and second railings, comprising a first horizontal flange and a second horizontal flange each flange extending laterally outward from a top edge of each vertical side wall in orthgonal relationship therewith, thus forming a right angled mounting surface to cooperate with the rectangular configuration of the first and second railings to securely position said corner pot holder at the railing corner in a suspended manner, wherein the container is concealed from view from the outside of the corner by the first and second railings.

2. The combination of claim 1 wherein the triangular container body is configured as an isosceles right triangle with the first and second vertical sidewalls of equal size;

3. The combination of claim 1 wherein the first and second sidewalls, and the back wall have a vertical height substantially equal to the height of the flower pots;

4. The combination of claim 1 wherein truncated apex is configured to cooperate with an interior right angle corner of a deck railing positioned at a corner of the deck to position the support means in total contact with the corner railing means to provide a snug and secure fit.

5. The combination of claim 1 wherein the first and second railing each comprise a first support structure positioned in a horizontal plane and a second support structure positioned in a vertical plane adapted to cooperate with the right angled mounting surface formed by the first horizontal flange and first vertical sidewall and the second horizontal flange and the second vertical sidewall.

6. The combination of claim 3 wherein the container means is supported in place solely by the pair of flanges fitted to the top of the corner railing means.

7. The combination of claim 1 wherein the support means positions the triangular container body such that the top of the flower pots and the top of said container are flush with the top of the surface of the corner railing means for concealing the plant pots below said corner railing means and exposing potted plants above said corner railing means.

* * * * *